United States Patent [19]

Rothenberg et al.

[11] Patent Number: 5,046,650

[45] Date of Patent: Sep. 10, 1991

[54] PORTABLE BOOT REMOVABLE DEVICE ATTACHABLE TO HEEL

[76] Inventors: Oscar Rothenberg; Carl Rothenberg, both of 681 Kingman Ave., Santa Monica, Calif. 90402

[21] Appl. No.: 525,129

[22] Filed: May 17, 1990

[51] Int. Cl.[5] ..... A47G 25/80

[52] U.S. Cl. ..... 223/113; 223/111; 223/115

[58] Field of Search ..... 223/113, 114, 115, 116, 223/118, 119, 111; 54/83 R

[56] References Cited

U.S. PATENT DOCUMENTS

| | | | |
|---|---|---|---|
| 307,014 | 10/1884 | Carpenter | 223/116 |
| 2,484,898 | 10/1949 | MacDonald | 54/83 R |
| 2,525,174 | 10/1950 | Johnstone | 223/114 |
| 2,876,942 | 3/1959 | Johnson | 223/114 |
| 3,734,364 | 5/1973 | Mayer | 223/116 |
| 4,394,946 | 7/1983 | McCormick | 223/115 |
| 4,606,483 | 8/1986 | Scarlata | 223/119 |

FOREIGN PATENT DOCUMENTS

| | | | |
|---|---|---|---|
| 140491 | 3/1902 | Fed. Rep. of Germany | 223/115 |
| 294431 | 3/1930 | Fed. Rep. of Germany | 54/83 |
| 652226 | 6/1935 | Fed. Rep. of Germany | 223/116 |

*Primary Examiner*—Werner H. Schroeder
*Assistant Examiner*—Bibhu Mohanty
*Attorney, Agent, or Firm*—Marvin H. Kleinberg

[57] ABSTRACT

A boot collar adapted to be attached to the end of a boot. The collar is generally U-shaped having an internal rib adapted to engage the land of the boot. In one embodiment, the collar has a boot removal arm with a first end pivotally mounted to the boot collar. The removal arm is normally biased in a stowed position and movable to a operable position. When in the second position, the removal arm provides a cantilever upon which force can be exerted to assist in removing the footwear from the foot. When in its normally biased stowed position it is disposed where it does not interfere with the wearing of the boot. In another embodiment, a mounting post having a rotatable spur is attached to the collar.

8 Claims, 3 Drawing Sheets

FIG. 1
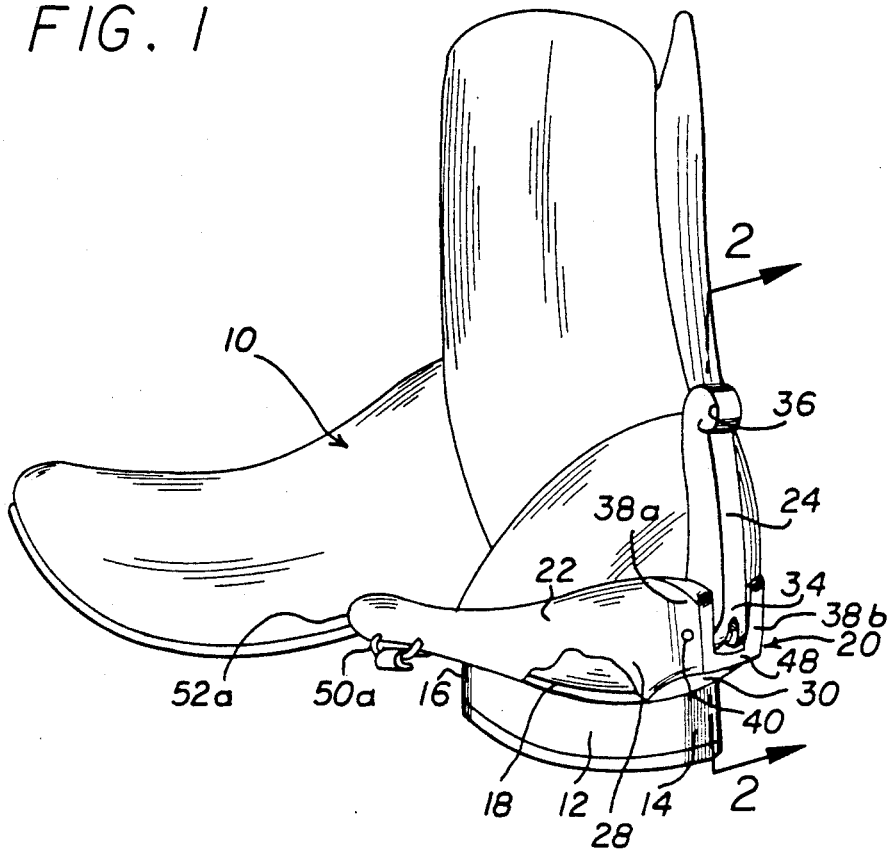
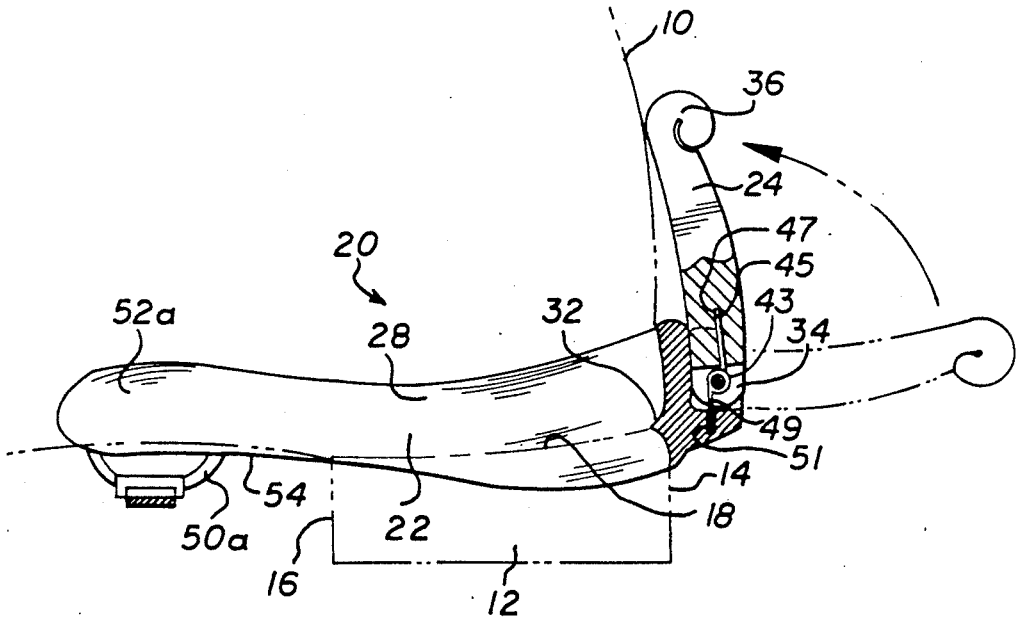
FIG. 2

FIG. 3
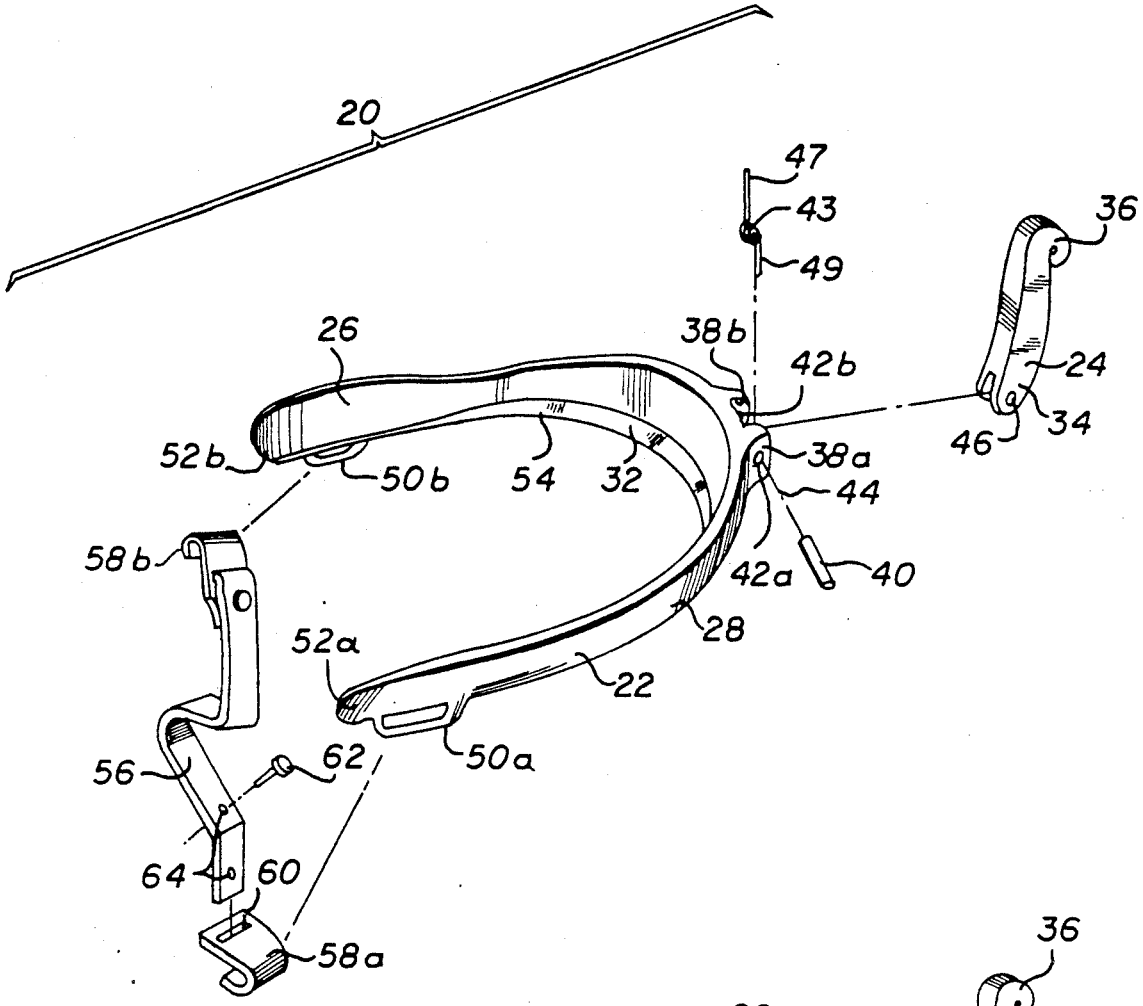
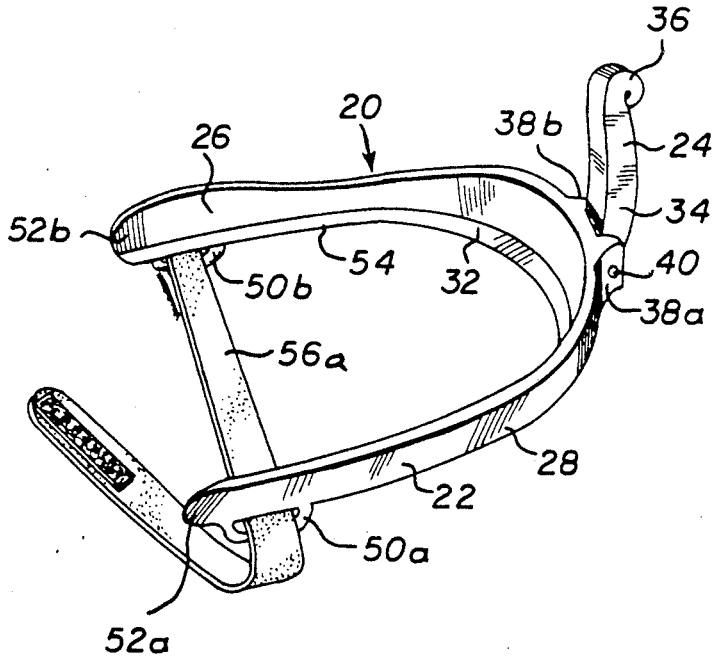
FIG. 4

PORTABLE BOOT REMOVABLE DEVICE ATTACHABLE TO HEEL

FIELD OF THE INVENTION

The present invention relates generally to footwear and more particularly to a novel apparatus worn on a boot.

BACKGROUND OF THE INVENTION

It is both practical and fashionable for outdoorsmen to affix items such as spurs to their boots. The typical spur mounting apparatus attaches firmly to the boot by the use of clamps, chain or the like, so as to rigidly hold the spurs in their proper position behind the heel of the boot. However, boot wearers often find the spur mounting apparatus "riding-up" the boot, out of its useful position. By increasing the tension on the mounting apparatus to prevent the spur misalignment, the wearer risks cutting or otherwise damaging the boot leather.

Wearers also find that well fitting boots are not easily removed and it is customary to use a boot jack to aid in boot removal. The typical boot jack comprises a length of board, or the like, having a v-shaped socket formed in one end thereof. The socket end of the board is elevated by an underlying attached support which positions the board on an incline. To use the boot jack, the user places one foot on the flat surface of the inclined board and places the rear of the other boot into the socket. By pulling back against the socket, the user can withdraw his foot and leg from the boot.

A common problem with these boot jacks is that they are not easily transportable due to their bulk and weight. Accordingly, a collapsible boot jack has been developed in the prior art. For example, see McCormick, U.S. Pat. No. 4,394,946. In the '946 patent, the boot jack comprises three hinged surfaces: an elongated planar base, an elongated planar link, and a generally U-shaped yoke. The user places one foot onto the planar base. The link elevates the yoke to a plane parallel to the base. The other foot having the boot to be removed is placed in the yoke, with the boot removed by applying pressure against the yoke. When not in use, the boot jack folds flat with the yoke and link pivoting to a common plane with respect to the base. A disadvantage and limitation of the boot jack described in the '946 patent is that it must be carried with the user whenever it is desired to be used, representing a significant inconvenience to the light travelling boot wearer.

SUMMARY OF THE INVENTION

It is therefore an object of the present invention to provide an apparatus for either assisting in the removal of the boot or attaching a spur thereto. Such an apparatus would be worn as part of the footwear itself.

According to the present invention, the apparatus includes a boot collar adapted to be attached to the land of the boot. In one embodiment, an elongated removal arm is pivotally mounted to the boot collar. The removal arm is normally biased in a stowed position and is movable to an operable position. When held in the operable position, the removal arm provides a cantilever upon which a force can be exerted to assist in removing the footwear from the wearer's foot.

In another embodiment, a spur may be removably attached to the boot collar. The spur rotates freely at the end of a mounting post which extends generally rearward from the boot collar.

An important advantage of the present invention is that the novel apparatus may be worn as a decorative element of the footwear while also providing a functional device. In normal wear, the spur is permanently poised to assist the wearer in accomplishing his daily chores. By pivoting the removal arm into its cantilever position, the apparatus is readily available at all times to assist in boot removal without any conscious effort by the user to carry it around.

These and other objects, advantages and features of the present invention will become readily apparent to those skilled in the art from a study of the following description of an exemplary preferred embodiment when read in conjunction with the attached drawings and appended claims.

BRIEF DESCRIPTION OF THE DRAWINGS

FIG. 1 illustrates the exemplary boot removing apparatus constructed according to the principles of the present invention, with the removal arm in its stowed position;

FIG. 2 is view, partially in cross-section and partially broken away, taken along line 2—2 of FIG. 1;

FIG. 3 is an exploded view of the boot removing apparatus shown in FIG. 1;

FIG. 4 illustrates an alternative embodiment of the boot collar mounting strap.

DESCRIPTION OF AN EXEMPLARY PREFERRED EMBODIMENT

Figure 5:
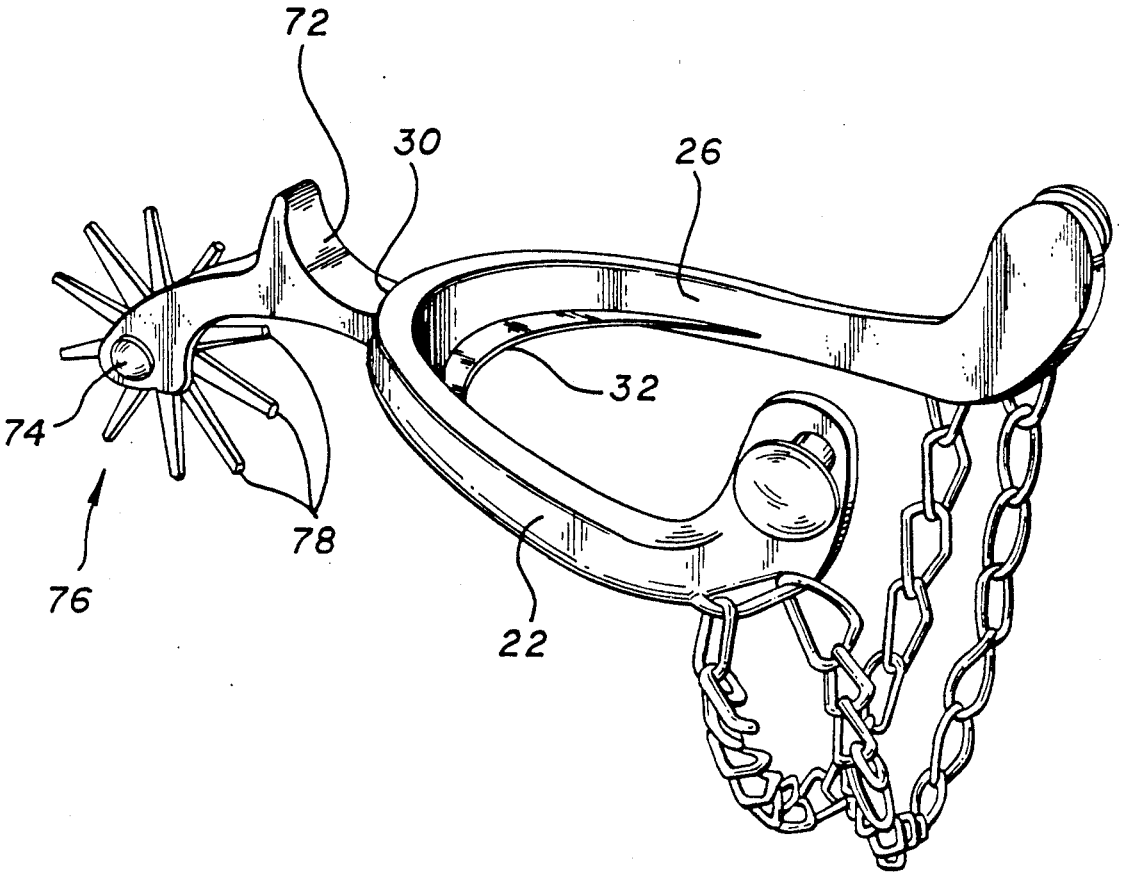
FIG. 5 illustrates the exemplary boot collar with the spur attached.

Referring now to FIGS. 1–4, there is shown an article of footwear 10, exemplarily shown herein as a conventional boot, having a heel 12. The heel has a rear portion 14, a forward edge 16 and a land 18. The land 18 is the indented edge formed by the interface between the sole and the upper portion of the boot 10.

According to the present invention, the boot apparatus 20 includes a generally U-shaped boot collar 22. As described in greater detail hereinbelow, the boot collar 22 is adapted to be removably attached to the boot 10. However, the boot collar 22 may be permanently attached to the boot 10 affixing the collar 22 by other means such as by nailing.

The boot collar 22 has an inner surface 26, an outer surface 28, a rear portion 30 and a rib 32 as can be seen in FIGS. 1 and 3. The rib 32 is disposed along the inner surface 26 and is generally coextensive with the U-shaped boot collar 22. As best seen in FIGS. 1 and 2, the U-shape boot collar 22 is attached to the boot 10 at the rear portion 14 of the heel. The rib 32, as best seen in FIG. 2, is engageable with the land 18.

In a first embodiment of the present invention, an elongated removal arm 24 is provided. The elongated removal arm 24 has a first end 34 and a second end 36 as shown in FIG. 3. The first end 34 is pivotally mounted to the rear portion 30 of the boot collar 22 as shown in FIG. 2. The removal arm 24 pivots between a normally biased stowed position (shown by the solid lines) and a operable position (shown in phantom). More particularly, the second end 36 of the removal arm 24 projects upwardly along the leg from the boot collar 22 when in its stowed position. When in its operable position, the removal arm 24 extends rearwardly from the boot collar 22. In the operable position, the removal arm 24 provides a cantilever projected backwardly from the boot 10.

To mount the removal arm 24 to the boot collar 22, the collar 22 includes a pair of spaced mounting bosses, 38*a* and 38*b*. As shown in FIG. 3, the mounting bosses 38*a* and 38*b* are disposed at the rear portion 30 of the boot collar 22 on the outer surface 28 thereof. The bosses 38*a* and 38*b* are accordingly positioned to extend rearwardly from the boot 10 and the boot collar 22. The first end 34 of the second member 24 is disposed between the mounting bosses 38*a*, 38*b* and rotatably mounted thereto.

To provide the pivotable mounting, the boot apparatus 20 further includes a mounting pin 40. Each of the mounting bosses 38*a*, 38*b* has an opening 42*a*, 42*b* commonly disposed about an axis of rotation 44, as best seen in FIG. 3. The first end 34 of the removal arm 24 has a bore 46 therethrough. The bore 46 receives the pin 40 in rotatable engagement. The pin 40 is pressingly fit into the openings 42*a*, 42*b* of each of the mounting bosses 38*a*, 38*b* coaxially aligned with the axis of rotation 44.

The boot collar 22 further includes a flange 48 as best seen in FIG. 1. The flange 48 projects outwardly between a lower edge of each of the mounting bosses 38*a*, 38*b*. The removal arm 24 engages the flange 48 when in the operable position. The flange 48 functions as a travel stop limit and further functions as a brace for the removal arm 24 when a downward force is applied thereto.

To keep the removal arm 24 biased in the stowed position, a coil spring 43 is coaxially disposed over the pin 40. A first radially projecting end 45 of the spring 43 is disposed within a bore 47 drilled within the removal arm 24, as best seen in FIG. 2. The spring 43 has a second radially projecting end 49 disposed within a bore 51 within the flange 48.

To secure the boot apparatus 20 to the boot 10, the boot collar 22 further includes a pair of bights 50*a*, 50*b*. Each of the bights 50*a*, 50*b* is disposed at a respective end portion 52*a*, 52*b* of the U-shaped boot collar 22 along the lower edge 54 thereof. The boot removing apparatus 20 further includes a strap 56 attachable to the bights 50*a*, 50*b*. The strap 56 is adapted to engage the forward edge 16 of the heel 12. In a preferred embodiment of the present invention, the strap may be constructed from leather.

In the embodiment as shown in FIG. 3, the strap 56 includes a hook 58*a*, 58*b* at each end of the strap 56. Each hook 58*a*, 58*b* is engageable with a respective one of the bights 50*a*, 50*b*. The hooks 58*a*, 58*b* may be fabricated from a suitable metal. To attach the hooks 58*a*, 58*b* to the ends of the strap 56, each of the hooks 58*a*, 58*b* includes a slot 60 dimensioned to receive the strap. The strap is put through the slot 60 and folded over. The folded over portion of the strap 56 is then fastened together by a rivet 62 through openings 64.

In an alternative embodiment of a strap, as best seen in FIG. 4, a modified strap 56*a* includes a loop and hook fastener, commercially available under the trademark Velcro, at each end thereof. The strap 56*a* is received through each of the bights 52*a*, 52*b*. One end of the strap 56*a* is attached to the other end of the strap by the loop and hook fastener 66. Other types of fastening means for the strap 56*a* may also be used, such as a buckle or a pin received through slots in place of the loop and hook fastener 66.

To use the exemplary boot apparatus 20 to remove one's boots, the user pivots the removal arm 24 from the stowed position to the operable position by use of the user's foot. Through a combination of rigidly holding the removal arm 24 with one foot, and applying an upward force on the foot desired to be removed from footwear 10, the foot can be easily pulled from within the footwear 10. Under other normal wearing conditions, the removal arm 24 would simply remain in the stowed position.

As seen in FIG. 5, the boot collar 22 may also be used to support a conventional spur. In this alternative embodiment of the invention, a mounting post 72 is provided at the rear portion 30 of boot collar 22. As described hereinabove, the boot collar 22 has a rib 32 which engages the land 18 of boot 10. The mounting post 72 extends generally rearward and slightly downward, and can be fabricated into a decorative shape.

At the end of the mounting post 72 a spur is provided, shown generally at 76. The spur 76 is generally star-shaped and has a multiplicity of spikes 78. Spur 76 rotatably mounts at the end of mounting post 72 by use of pin 74 which extends through the center of the spur.

It is anticipated that the boot collar 22, removal arm 24 and mounting post 72 be constructed of a brilliant metal, such as brass, to provide a decorative feature to the footwear. It is also anticipated that decorative engraving be provided on the outer surface 28 of boot collar 22.

There has been described hereinabove a novel boot apparatus constructed according to the principles of the present invention. It is apparent that those skilled in the art may now make numerous uses of and departures from the above described exemplary preferred embodiment without departing from the inventive concepts disclosed herein. Accordingly, the present invention is to be defined solely by the scope of the following claims.

I claim:

1. In combination with an article of footwear having a heel, said heel having a rear portion, a forward edge and a land, an apparatus to be normally worn with said footwear and for assisting in the removal of said footwear from a foot of a wearer thereof, said apparatus comprising:

a generally U-shaped boot collar having an inner surface, an outer surface, a rear portion and a rib disposed along said inner surface generally coextensive with said boot collar, said boot collar being received by said article of footwear at said rear of said heel, said rib being engageable with said land;

a generally elongated removal arm having a first end and a second end, said first end being pivotally mounted to said rear portion of said boot collar, said removal arm being pivotable between a normally biased stowed position and an operable position, said second end of said removal arm projecting generally orthogonally upwardly from said boot collar when in said stowed position to extend along a rear edge of said footwear above said heel and generally rearwardly from said boot collar when in said operable position wherein said removable arm provides a cantilever projecting backwardly from said article of footwear; and means for securing said boot collar to said article of footwear.

2. An apparatus as set forth in claim 1 wherein said securing means includes:

a pair of bights, each of said bights being disposed at a respective end portion of said U-shaped boot collar along a lower edge thereof; and a strap attachable to said bights, said strap being adapted to engage said forward edge of said heel.

3. An apparatus as set forth in claim 2 wherein said strap includes a hook at each end thereof, each hook being engageable with a respective one of said bights.

4. An apparatus as set forth in claim 2 wherein said strap includes a loop and hook-type fastener at the end thereof, said strap being received through each of said bights, one end of said strap being attachable to the other end of said strap.

5. An apparatus as set forth in claim 1 wherein said boot collar includes a pair of spaced mounting bosses disposed at said rear portion of said boot collar on said outer surface thereof, said first end of said removal arm being disposed between said mounting bosses and pivotally mounted thereto.

6. An apparatus as set forth in claim 5 further comprising a mounting pin, each of said mounting bosses having an opening commonly disposed about an axis of rotation, said first end further having a bore therethrough, said bore receiving said pin in rotatable engagement, said pin being pressingly fit into said opening of each of said mounting bosses coaxially with said axis of rotation.

7. An apparatus as set forth in claim 5 wherein said boot collar further includes a flange projecting outwardly between a lower edge of each of said mounting bosses, said removal arm engaging said flange when in said operable position.

8. An apparatus as set forth in claim 1 wherein said article of footwear is a boot.

* * * * *